United States Patent [19]

Smith

[11] Patent Number: 4,496,006

[45] Date of Patent: Jan. 29, 1985

[54] CYLINDER DISPLACEABLE POWER SWIVEL FOR A PORTABLE DRILLING APPARATUS AND A PROCESS THEREFOR

[76] Inventor: Albert W. Smith, 2415 Holley St., Tyler, Tex. 75701

[21] Appl. No.: 491,531

[22] Filed: May 4, 1983

[51] Int. Cl.[3] ..... E21B 7/02

[52] U.S. Cl. ..... 173/28; 173/22

[58] Field of Search ..... 173/23, 28, 164, 43; 52/115, 116

[56] References Cited

U.S. PATENT DOCUMENTS

| | | | |
|---|---|---|---|
| 2,423,301 | 6/1947 | Fairchild | 173/28 |
| 2,617,500 | 11/1952 | Cardwell et al. | 52/115 |
| 2,715,954 | 8/1955 | Rowan | 52/115 |
| 2,848,196 | 8/1958 | Simmonds | 173/147 |
| 2,852,111 | 9/1958 | Fuller et al. | 52/115 |
| 2,956,782 | 10/1960 | Mistrot | 173/147 |
| 3,280,920 | 10/1966 | Scott | 173/164 |
| 4,135,340 | 1/1979 | Cox et al. | 52/115 |
| 4,269,395 | 5/1981 | Newman et al. | 254/386 |
| 4,290,495 | 9/1981 | Elliston | 175/85 |

*Primary Examiner*—Donald R. Schran
*Assistant Examiner*—James Wolfe

[57] ABSTRACT

A cylinder displaceable slide gate and power swivel for well drilling rigs and the like comprising a longitudinally extending frame having an upper end and a lower end and including a ground supported base connected to said lower end; cylinder means secured to said base and including piston means adapted for reciprocating displacement between said base and said upper end; a plurality of longitudinally extending guide means connected to said frame and substantially spanning said frame from said lower end to said upper end; said slide gate and said power swivel connected to said piston means and displaceable therewith; and, said slide gate and said power swivel associated with said guide means is disclosed herewith.

9 Claims, 5 Drawing Figures

CYLINDER DISPLACEABLE POWER SWIVEL FOR A PORTABLE DRILLING APPARATUS AND A PROCESS THEREFOR

BACKGROUND OF THE INVENTION

As the search for oil and gas, as well as other subterranean deposits, has increased, the need for a portable self-contained drilling rig capable of drilling to the depths required has arisen.

Prior art drilling rigs were either large complicated relatively immovable structures or were small relatively unsophisticated apparatus, and of which Leonard, U.S. Pat. No. 2,904,310 is a good example. Leonard discloses a truck mounted drilling rig in which the drilling frame is at an incline relative to the truck body when in operation. Leonard employs a pair of cooperating cylinders mounted to the upper end of the drilling frame with the swivel mounted at the lower end of the pistons. The disadvantage of an assembly such as Leonard is the use of the pair of cylinders suspended from the upper end of the drilling rig and the fact that the drilling frame may become bent or distorted because of the rotary action of the power swivel being transmitted to the frame and causing distortion thereof.

Consequently, a lightweight portable drilling apparatus having a minimal number of parts is desirable. The added capability of directly connecting the rotary power swivel to a length of drill pipe is desirable and results in a further decreased amount of necessary equipment and also results in decreased amount of labor. Such a drilling rig is highly desirable for the foregoing reasons and also because the resulting structure minimizes the risk of injury to the drilling rig operating personnel.

OBJECTS AND SUMMARY OF THE INVENTION

It is a primary object of the disclosed invention to provide a cylinder displaceable slide gate and power swivel for a portable drilling rig.

It is a further object of the disclosed invention to provide a drilling rig which is capable of being mounted on a moveable support frame in which the operating controls and equipment are located within the support frame.

Still another object of the disclosed invention is to provide a drilling rig frame which is reinforced for preventing the twisting and bending of the frame caused by the rotary operation of the power swivel.

Yet another object of the disclosed invention is to provide a portable drilling rig adapted for being displaced from a relatively horizontal position to a substantially vertical operating position.

Still yet another object of the disclosed invention is to provide an independent attachable pipe ramp and pipe rack for positioning drill pipe adjacent the pivoting power swivel.

Yet a further object of the disclosed invention is to provide a process for connecting and disconnecting the power swivel to the drill pipe for raising and lowering of the drill pipe.

Still yet another object of the disclosed invention is to provide a multi-stage hydraulic cylinder and piston secured to the base of the drilling rig and extending reciprocatingly upwardly for displacing a slide gate and the attached power swivel.

Yet still a further object of the disclosed invention is to provide hydraulic means for leveling the drilling frame.

Yet an additional object of the disclosed invention is to provide spaced parallel guide means for guiding the slide gate and power swivel.

Still yet another object of the disclosed invention is to provide a drilling rig having a minimum number of parts and providing increased worker safety.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figures 1, 3:
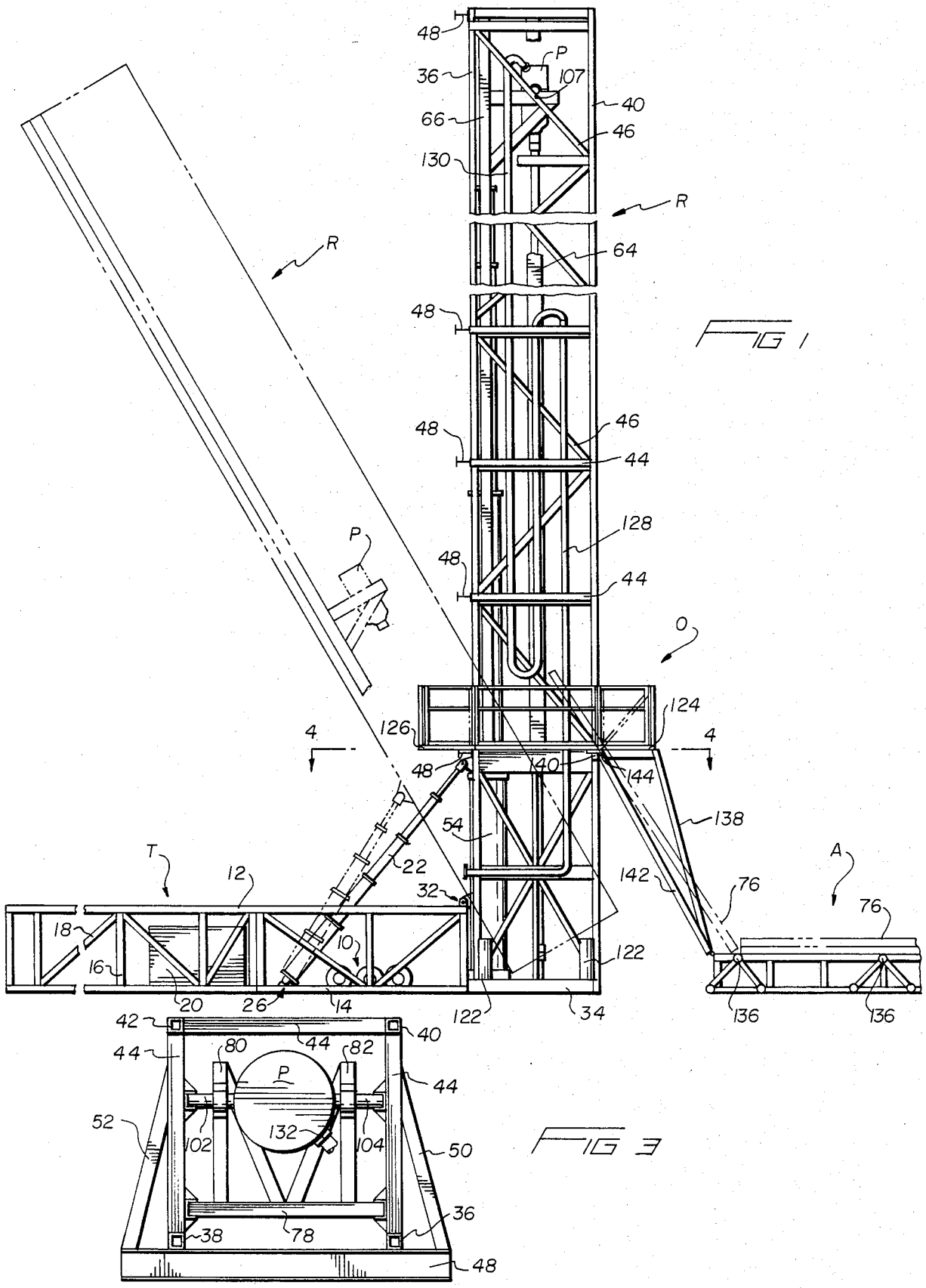
FIG. 1 is a fragmentary side elevational view of the drilling rig of the invention with portions shown in phantom and with phantom lines showing angular displacement of the rig.
FIG. 3 is a fragmentary top plan.
Figure 4:
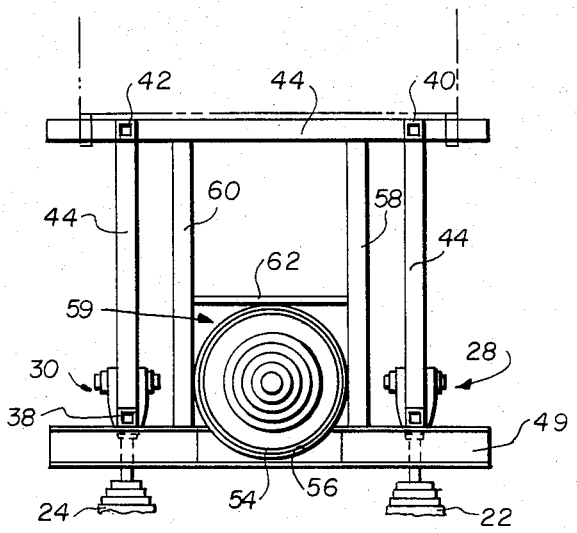
FIG. 4 is a fragmentary cross sectional view taken along the Section 4—4 of FIG. 1 and viewed in the direction of the arrows; and, FIG. 5 is an enlarged fragmentary perspective view of the slide gate holding the pivotable power swivel, with portions shown in phantom.

As best shown in FIG. 1, a drilling rig frame R is connected to a support frame or trailer T. The trailer T may be pulled by a tractor (not shown) or other motive means when the rig R is horizontally positioned atop the trailer T. The trailer T has at least two sets of cooperating wheels 10, of which only one set is shown, and which wheels 10 are displaceable from a first ground engaging position adapted for traveling (not shown) and a second position in which the wheels are pivoted above the underside of the lower frame of the trailer T. The trailer T is a rectangular structure having an upper rectangular frame 12 and a lower rectangular frame 14 and having a plurality of spaced parallel members 16 disposed therebetween. Preferably, the trailer T also includes a plurality of truss members 18 connecting adjacent members 16. Trailer T preferably includes a compartment or housing 20 which contains the pumps, motors, and operating controls (not shown) used for operating the drilling rig of the invention. Trailer T contains at least two multi-stage cylinders 22 and 24, as best shown in FIGS. 1 and 4, which are pivotably connected at their lower end to the frame 14 by pivotable connections 26. Cylinders 22 and 24 are likewise pivotably connected at their upper ends to the rig R by pivoting members 28 and 30, respectively. Rig R is pivotably connected to the back end of trailer T by pivoting members 32. As shown in phantom in FIG. 1, rig R is angularly displaceable around an axis coincident with pivoting hinged members 32 by means of cylinders 22 and 24 which are adapted for displacing the rig R from an essentially horizontal position to a substantially vertical operating position.

Rig R has a flat rectangular ground supported base member 34 and at least four spaced parallel members 36, 38, 40 and 42 extending transversely from the outermost corners of base 34. A plurality of frame members 44 disposed in a spaced parallel relationship connect frame members 36, 38, 40 and 42 and are disposed transversely thereto. Frame members 44 cooperate with frame members 36, 38, 40 and 42 in order to provide a rectangular frame having an open interior. Preferably, rig R includes a plurality of angularly disposed truss members 46 cooperating with frame members 36, 38, 40, 42 and 44 to further increase the strength and rigidity of the rig R.

Preferably, rig R includes a plurality of spaced parallel support members 48 at least spanning the frame members 36 and 38 and located adjacent frame members 44. Support members 48 may extend outwardly from frame members 36 and 38, as best shown in FIG. 3, and include a plurality of angularly disposed support members 50 and 52 connecting the outer most ends of support members 48 to frame members 44. In this way the rig R has increased strength and rigidity and the support members 48, in cooperation with angle members 50 and 52, prevent twisting and bending of the rig R during operation of a power swivel P.

As best shown in FIG. 1 and FIG. 4, a multi-stage hydraulic cylinder 54 is securely fastened to base 34 and extends transversely of base 34 and within the confines of rig R as defined by members 36, 38, 40 and 42. Cylinder 54 is a multi-stage hydraulically adjustable and positionable cylinder which is capable of spanning the length of frame R. As best shown in FIG. 4, support member 49 at the upper end of the cylinder 54 includes a recess 56 to permit positioning of the cylinder 54 which because of its size and positioning would otherwise interfere with support member 49. Cylinder frame members 58 and 60 extend transversely of support 49 and parallel to parallel frame members 44 and span the distance between members 36 and 40 and between members 38 and 42. Transverse member 62 spans the distance between frame members 60 and 58 and is adjacent the exterior of cylinder 54 and in this way a housing or compartment 59 is established for positioning cylinder 54 therein. Members 58, 62, 60 and 49, including recess 56, are uniquely adapted for maintaining cylinder 54 transverse of base 34 in a rigid construction.

Spaced parallel cooperating guide members 64, 66, 69 and 70 extend transversely of base 34 and parallel to frame members 36, 38, 40 and 42 and span the length of rig R from adjacent operating platform O to the upper end of rig R. Guide members 64, 66, 68 and 70 are channel-type members in which the open channel of one member, such as guide member 64, cooperates with the open channel of an adjacent member, such as guide member 70. Guide members 66 and 68 cooperate likewise. Guide members 64, 66, 68 and 70 are securely fastened to frame members 44, such as by welding, and further add to the strength, stability, and rigidity of rig R.

Figure 2:
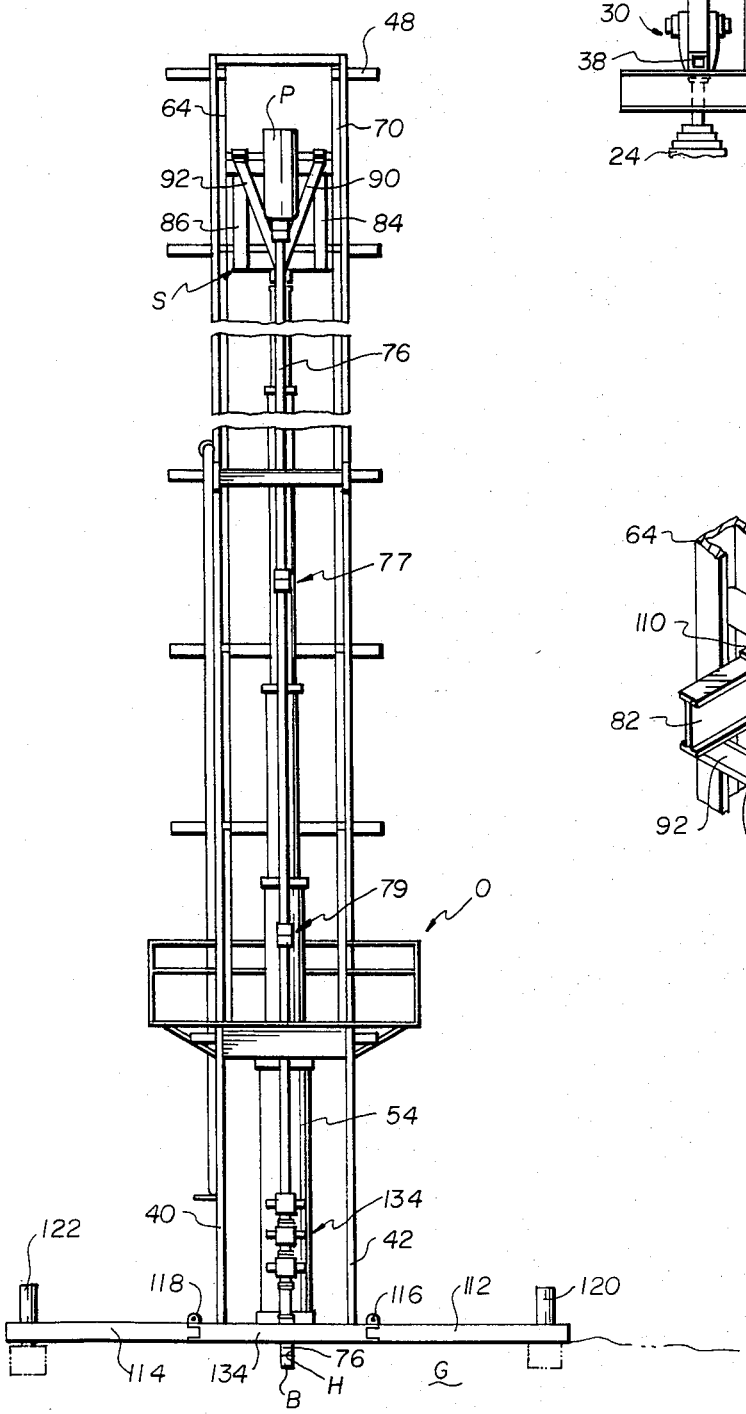
FIG. 2 is a fragmentary front elevational view.
Figure 5:
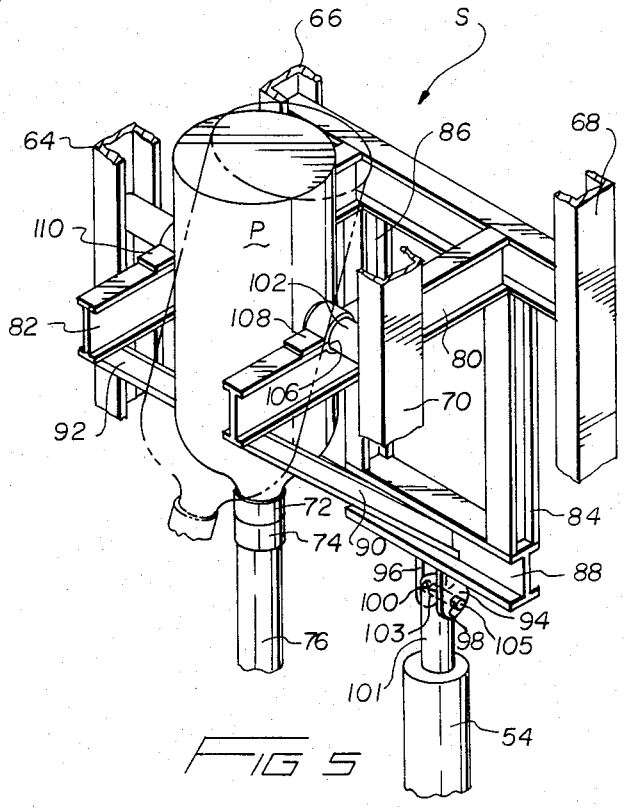

A slide gate assembly S, as best shown in FIG. 5, is positioned in cooperating guide members 66, 68, 64 and 70 and is adapted for being reciprocatingly displaced by cylinder 54. As best shown in FIG. 2, slide gate S is connected to the upper end of cylinder 54 and, as best shown in FIG. 1 in phantom lines, is uniquely adapted for being displaced longitudinally by cylinder 54 within rig R.

A power swivel P is pivotably mounted to slide gate S and is displaceable with slide gate S. Power swivel P includes a rotateable coupling 72 adapted for cooperating with a coupling 74 connected to a length of drill pipe 76. A plurality of lengths of drill pipe 76 are ordinarily coupled together as at 77 and 79 and a drill bit B is at the lowermost end thereof. In this way the drill pipe 76 spans the length of the bore hole H. The power swivel P is adapted for rotating the connected length of drill pipe 76 and which thereby causes the drill bit B to rotate so that the bore hole H may be excavated.

Slide gate S includes a frame member 78 spanning cooperating guide means 66 and 68 and displaceable therein. Spaced parallel cooperating arm members 80 and 82 extend outwardly from frame member 78 and extend beyond the plane of cooperating guide members 64 and 70. Bracket members 84 and 86 extend downwardly from frame member 78 and are maintained in a spaced parallel position by bottom support member 88. Bracket members 84 and 86 are rigidly connected to bottom support 88, such as by welding, and arm members 80 and 82 are rigidly connected to frame members 78, such as by welding. Angularly disposed support arms 90 and 92 extend upwardly and angularly from the center of the web of bottom support 88 and are rigidily connected to bottom support 88 and arm members 80 and 82, respectively, such as by welding. Cooperating ears 94 and 96 are disposed in a spaced parallel relationship and extend downwardly from the lower surface of bottom support 88. Ears 94 and 96 contain cooperating apertures 98 and 100, respectively. The upper end of piston 54 contains a knuckle or member 101 having an aperture 103 adapted for receipt of a pin 105 so as to connect slide gate S with cylinder 54. In this way the slide gate S, as well as attached power swivel P, is joined to cylinder 54 and is adapted for reciprocating displacement therewith.

Power swivel P is mounted on arms 80 and 82 a distance from frame member 78 by means of attached shaft or rod members 102 and 104. Rod members 102 and 104, respectively, extend from power swivel P and engage guide members 70 and 64, respectively, and are adapted for longitudinal reciprocating movement as guided by guide members 70 and 64. Rod members 102 and 104 are coaxial and power swivel P is adapted for rotating on arm members 80 and 82 along the axis defined by rod members 102 and 104. Preferably, the arm members 80 and 82 contain semi-circular recesses, 106 and 107 which are adapted for receiving the rod members 102 and 104. Journal members 108 and 110 are secured to arm members 80 and 82, respectively, and maintain rod members 102 and 104, respectively, in rotating engagement with their respective arm members 80 and 82. Preferably, rod members 102 and 104 include circumferential bearings (not shown) to further aid in the pivoting of power swivel P. Because of the rod members 102 and 104, power swivel P is free to rotate on the axis defined by rod members 102 and 104 while being displaced vertically by piston 54. Power swivel P rotates drill pipe 76 along an axis which is spaced a distance from the axis of cylinder 54 and which is transverse of rods 102 and 104.

As best shown in FIG. 2, cooperating base supports 112 and 114 extend from opposed edges of base 34 and, preferably, are angularly displaceable from a first folded position parallel to rig R to a second operable position transverse of rig R by means of hinges 116 and 118. Base supports 112 and 114, preferably, include cooperating pairs of cylinder and piston means 120 and 122 mounted at the outer most edges of supports 112 and 114. Piston means 120 and 122 are adapted for extending through supports 112 and 114 for bearing against the ground G. Cylinder means 120 and 122 may be operated so that by pressing against the ground G the axis of the rig R may be maintained in the vertical position when the rig R is initially placed on the ground after being rotated by pistons 22 and 24 from the upper frame 12 of the trailer T. Preferably, base supports 112 and 114 will each contain a pair of cylinders, 120 and 122 of which one pair is shown in FIG. 1.

Operating platform O is hingedly connected to rig R and is adapted for being disposed in a first folded position in which platform members 124 and 126 are maintained folded and parallel to rig R and a second operable condition in which the platform members 124 and 126 extend outwardly from rig R transverse of the members 36, 38, 40 and 42. Operating platform O is sized so that a roustabout or rig operator may perform the necessary duties on operating platform O.

Preferably, a mud pipe 128 is connected to frame R and extends upwardly from the lower end of frame R to a point intermediate the upper end of frame R and includes a hose 130 extending from the upper end of mud pipe 128 and connected to power swivel P by coupling 132. In this way drilling mud (not shown) of all types may be pumped up to the power swivel P for reasons which are well known in the art.

As best shown in FIG. 2, a blow-out preventer 134 may be mounted around an aperture (not shown) in base 34 coincident with the axis of drill pipe 76. The use of such blow-out preventers 134 is well known in the art.

A pipe rack A is positioned adjacent rig R and is adapted for holding a plurality of individual lengths of drill pipe 76. Pipe rack A includes a plurality of bracing members 136. Rack brace 138 extends angularly and upwardly from pipe rack A and is connected at its upper end to the outer most periphery of platform member 124. A lug 140 extends outwardly from member 40 and a pipe ramp 142 extends upwardly from pipe rack A and includes an ear 144 which cooperates with lug 140 to secure pipe ramp 142 to rig R. Pipe ramp 142 is uniquely adapted by means of spaced parallel upstanding members for preventing a length of drill pipe 76 from falling from pipe ramp 142. Pipe ramp 142, preferably includes means for holding a length of drill pipe 76 on pipe ramp 142 and for preventing the rotation of the length of drill pipe 76.

OPERATION

Trailer T, with rig R supported by and maintained parallel to upper frame 12, is transported on ground engaging wheels 10 by means (not shown) to the location to be drilled. Once properly located, wheels 10 are displaced upwardly out of ground contact and the cylinders 22 and 24 extend and cause the rig R, because of hinged connections 32, to be angularly displaced from the horizontal traveling position to the substantially vertical operating position.

After the rig has attained the vertical position, the operating platform members 124 and 126 are folded outwardly and the base supports 112 and 114 are likewise folded outwardly and locked in position. The hydraulic, electric, and instrument connections (not shown) used for operating the drill rig of the invention are run from housing 20 to the appropriate operating members. Cylinder and piston means 120 and 122 are displaced to true up the parallel axes of cylinder 54 and the axis around which the power swivel P rotates the drill pipe 76. When the rig R is in the operating position and after the mud hose 130 is connected to the mud pipe 128 and the power swivel P, the power swivel P is ready to pick-up the first length of drill pipe 76.

The first length of drill pipe 76 will normally contain the drill bit B used for producing the bore hole H. Mud pipe 128 extends some distance upwardly as shown in FIG. 1 to provide sufficient slack in mud hose 130 when the slide gate S is raised or lowered. The drill pipe 76 is placed on pipe ramp 142, as best shown in FIG. 1, and the cylinder 54 is displaced upwardly until power swivel P is adjacent the uppermost end of the piece of drill pipes 76 on pipe ramp 142. The drill pipe 76 is clamped into position by holding means well known in the art and the power swivel P is pivoted on the axis defined by rod members 102 and 104 until coupling 72 is adjacent coupling 74 of drill pipe 76. The cylinder 54 is adjusted until coupling 72 makes contact with coupling 74 and power swivel P. Coupling 72 is rotated so as to engage coupling 74 of drill pipe 76. Coupling 72 continues to rotate until the drill pipe 76 and coupling 74 are positively secured to the power swivel P. Once the couplings 72 and 74 are made fast, the cylinder 54 may be displaced upwardly so that drill pipe 76 is pulled upwardly along pipe ramp 142 until above operating platform member 124 and at which point the drill pipe 76 and the power swivel P rotate downwardly and angularly into the vertical position. Cylinder 54 is then displaced downwardly until the drill pipe 76 passes through blow-out preventer 134 and the drill bit B may begin cutting a bore hole H in the ground G because of the rotation imparted to the drill pipe 76 by means of the rotating of coupling 72 of power swivel P. As the drill bit B begins to cut a bore hole H, the cylinder 54 may be displaced downwardly so as to maintain a substantially uniform bearing pressure on the drill bit B. This substantially uniform bearing pressure may be adjusted to obtain the optimum results because of the precise control of the displacement of cylinder 54 which enables the operator to control the rate at which the drill pipe 76 descends into the ground G.

When couplings 74 on the upper end of drill pipe 76 reaches the top of the blow-out preventer 134, the drill pipe 76 is secured to blow-out preventer 134 and the power swivel P reverses its rotation and breaks free the coupling 72 from the coupling 74. Cylinder 54 is then displaced upwardly until the power swivel P is adjacent a second length of drill pipe 76 which has been placed and secured on pipe ramp 142. The power swivel P is connected to the length of drill pipe 76 by the above described procedure and after the power swivel P and the second length of drill pipe 76 and in the vertical position, the cylinder 54 is displaced downwardly until the lower end of the second length of drill pipe 76 makes contact with the coupling 74 of the first length of drill. The power swivel P rotates coupling 72 and the lower end of the second length of drill pipe 76 engages with and is secured to coupling 74. The blow-out preventer is then adjusted so that the descent of the drill bit B may continue. In this way many lengths of drill pipe 76 may be picked-up by power swivel P and used for drilling purposes.

Should it be necessary to remove the lengths of drill pipe 76 in the bore hole H then the drill pipe 76 is pulled upwardly out of the hole H by means of upward displacement of piston 54 until a length of drill pipe 76 is exposed. The newly exposed length of drill pipe 76 is secured by blow-out preventer or bowl 134 and the rotation of power swivel P coupling 72 causes the first length of drill pipe 76 to be rotated and disconnected from the newly exposed length of drill pipe 76. The cylinder 54 is then displaced upwardly until the lower end of the newly freed length of drill pipe 76 is adjacent operating platform member 124. At this point the drill rig operator (not shown) pivots the length of drill pipe 76 and thereby pivots power swivel P and the cylinder 54 then descends downwardly so that the drill pipe 76 slides along the pipe ramp 142. When the length of drill pipe contacts the pipe rack A the drill pipe 76 is secured to the pipe ramp 142 and the power swivel coupling 72 rotates to free itself from the coupling 74 or the length of drill pipe 76. This procedure may be repeated until all of the drill pipes 76 is removed from the bore hole H.

While this invention has been described as having a preferred design, it is understood that it is capable of further modifications, uses and/or adaptations of the invention following in general the principles of the invention and including such departures from the present disclosure as come within known or customary practice in the art to which the invention pertains, and as it may be applied to the central features hereinbefore set forth, and falls within the scope of the invention of the limits of the appended claims.

What I claim is:

1. A cylinder displaceable slide gate and power swivel for well drilling rigs and the like, comprising:

(a) a longitudinally extending rig frame having an upper end and a lower end and including a ground supported base connected to said lower end;

(b) a first cooperating pair and a second cooperating pair of guide means secured to said frame and extending substantially between said upper end and said lower end, each of said pairs of guide means includes a pair of guide members;

(c) multi-stage cylinder and piston means secured to said base between a first one of said first and second pair of guide means and generally equidistant the guide members thereof;

(d) a slide gate assembly secured above and to said cylinder and piston means and displaceable therewith substantially between said upper end and said lower end;

(e) a plurality of guide means extend from said slide gate assembly and cooperate with said guide members of said first and second pair of guide means for guiding said slide gate assembly during displacement thereof;

(f) a plurality of spaced generally parallel support members are secured to said frame generally transverse to said guide members and are adapted for preventing bending of said frame during operation of said drilling rig;

(g) a power swivel connected to said slide gate assembly and displaceable therewith and adapted for rotating drill pipe on an axis parallel to and spaced from said cylinder and piston means axis;

(h) said power swivel axis being aligned with and spaced generally equidistant from the guide members of the other pair of said first and second pair of guide means; and, (i) means for operating said cylinder and piston means and for operating said power swivel.

2. A slide gate and power swivel as in claim 1, wherein:

(a) said power swivel is pivotally secured to said slide gate assembly.

3. A slide gate and power swivel as defined in claim 1, wherein:

(a) each of said guide members includes a channel.

4. A slide gate and power swivel as in claim 3, further comprising:

(a) a pair of journal means mounted on said slide gate assembly, each of said journal means adjacent one of said channels; and, (b) channel engaging means extends from said slide gate assembly and includes at least one pair of opposed shafts, each of said shafts associated with one of said journal means and said at least one pair of opposed shafts rotatably connected to said associated journal means for permitting pivoting of said power swivel.

5. A slide gate and power swivel as in claim 4, further comprising:

(a) a pipe rack adjacent said base;

(b) a pipe ramp connected to said pipe rack and to said rig frame; and, (c) pipe securing means connected to said power swivel and displaceable therewith for lifting drill pipe from said pipe rack and along said pipe ramp for positioning said drill pipe.

6. A slide gate and power swivel as in claim 1, further comprising:

(a) said frame being mounted on a mobile vehicle.

7. A slide gate and power swivel as in claim 6, further comprising:

(a) said vehicle having a longitudinally extending body with an upper frame and a lower frame and being adapted for supporting said rig frame;

(b) said rig frame hingedly connected to said body; and, (c) cylinder means connected to said body and said rig frame and adapted for displacing said rig frame from a first position parallel to said body to a second position transverse of said body.

8. A slide gate and power swivel as in claim 1, further comprising:

(a) a plurality of opposed platforms extending from said base transverse of said frame; and (b) cylinder and piston means secured to each of said plurality of platforms and extending from each of said plurality of platforms and parallel to said rig frame and including piston means adapted for displacing said base and thereby said frame.

9. A slide gate and power swivel as in claim 8, wherein:

(a) said cylinder means for displacing said rig frame include multi-stage cylinder means.

* * * * *